US006048603A

United States Patent [19]

Ruppel et al.

[11] Patent Number: 6,048,603

[45] **Date of Patent: *Apr. 11, 2000**

[54] LAMINATED PRODUCT MADE OF CELLULOSE WAD

[75] Inventors: Remy Ruppel, Durrenentzen; Pierre Laurent; Pierre Probst, both of Colmar, all of France

[73] Assignee: Fort James France, Courbevoie Cedex, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/738,703

[22] Filed: Oct. 28, 1996

Related U.S. Application Data

[63] Continuation of application No. 08/436,476, filed as application No. PCT/FR93/01146, Nov. 22, 1993.

[30] Foreign Application Priority Data

Nov. 24, 1992 [FR] France ..... 92 14063

[51] Int. Cl.[7] ..... B31D 1/04

[52] U.S. Cl. ..... 428/195; 428/194

[58] Field of Search ..... 428/195, 194

[56] References Cited

U.S. PATENT DOCUMENTS

| | | | |
|---|---|---|---|
| 2,897,108 | 7/1959 | Harwood et al. | 428/194 |
| 3,673,060 | 6/1972 | Murphy et al. | 428/194 |
| 4,300,981 | 11/1981 | Carstons . | |

FOREIGN PATENT DOCUMENTS

| | | | |
|---|---|---|---|
| 363699 | of 1932 | United Kingdom | 428/194 |

*Primary Examiner*—Michael P. Woodward
*Attorney, Agent, or Firm*—Breiner & Breiner

[57] ABSTRACT

The cellulose fiber (tissue) product of the invention, such as a handkerchief or napkin, is made by combining at least two tissue plies cut into a desired format and connected to one another along a peripheral zone, and is characterized in that the plies are adhesively bonded along the perhipheral zone in such a manner that they evince a minimum delamination strength of 1 g/cm, and the peripheral zone is less than 50% of the total product surface.

13 Claims, 1 Drawing Sheet

LAMINATED PRODUCT MADE OF CELLULOSE WAD

This is a continuation of application Ser. No. 08/436,476 filed on May 23, 1995, abandoned, filed as PCT/FRO3/01146 on Nov. 22, 1993.

The invention concerns household paper and tissues and the manufacture of laminated, i.e., stratified, products composed of at least two plies, or cellulose wad, in particular for use as handkerchiefs, napkins and similar purposes.

Presently commercially sold paper handkerchiefs, also called "tissues", as a rule are boxed and composed of several creped and superposed paper sheets kept together by a peripheral mechanical link. This link is implemented by steel/steel or steel/paper embossing when the sheets are being made to pass between two mutually meshing cylinders. One cylinder comprises bosses and the other the matching recesses. In this manner, the sheets are locally shaped into zones constituting attachment points. A known repeat-pattern of embossing consists of a number of low, small-diameter pins which are tightly arrayed linearly with respect to one another or in the two directions of advance or the direction transverse to advance. Another known repeat-pattern of embossing consists of fine ridge-forming bars running tightly parallel to each other. Such linking is satisfactory when the density of the plies is moderate, namely about 10 to 20 g/m$^2$, and when additive-free tissue is used.

However, this linkage mode entails a number of drawbacks:

- the selection of the embossing patterns is limited since it is governed by the constraint that the plies hook into each other,
- the linkage will be inoperative when paper is desired which evinces plies of different properties such as differential elongation among the plies, or is different in their chemical or fiber composition, for example, adding a loosening agent to make the paper softer is impossible since the plies will then not hook into each other,
- embossing imparts roughness which is unpleasant when the tissue is used as a handkerchief.

The invention remedies these drawbacks by providing a product, such as a napkin or handkerchief, composed of a combination of at least two individual tissue plies or sheets cut into a desired form or shape and connected to one another along a peripheral zone in such a manner that the plies are adhesively bonded along the peripheral zone so that they present a minimum delamination strength of 1 g/cm, wherein the peripheral zone is less than 50% of the total surface of the product.

The bonding is implemented using any adhesive conventionally used for connecting tissue and household paper plies to one another, for example a polyvinyl alcohol in an aqueous medium.

Preferably, the bonding is carried out along the four edges of the plies. For simplicity of discussion, a square or rectangular format will be assumed. The invention also covers the case of when only two opposite edges are bonded.

Bonding is performed along a peripheral zone subtending a strip of which the width can vary from a lower limit corresponding to sufficient delamination strength to an upper limit beyond which the product would be too stiff. The bonded zone must be less than 50% of the product, i.e., a handkerchief or table napkin. In an especially preferred embodiment, the zone is between 30% and 40% of the total surface.

Bonding along this zone can be carried out by a continuous adhesive coating or also by applying adhesive to a plurality of small areas linearly arrayed or at uniformly distributed spots in the zone. In the latter case, a preferred embodiment is that described in French Patent No. 89 14202 allowing uniform adhesive deposition in a connection zone without thereby stiffening a sheet.

Applicant is well aware that tissue napkins with interbonded plies are already known. Illustratively, U.S. Pat. No. 3,673,060 describes a table napkin made in such a manner that two tissue plies are superposed one on the other so that they will evince mutually parallel creping lines and adhere to one another at spots. Be it noted that this bonding is uniformly spread over the entire napkin area along adjacent spots and that restricted bonding at the sheet's edge is not used. This kind of product is unsatisfactory to the extent that the central operative zone is degraded at its surface and in its flexibility.

The proposed solution allows manufacturing of stratified products (such as handkerchiefs, napkins and other similar products), that is, products in the form of single sheets with excellent delamination strength while still being free of stiffening at the center (i.e., in the functional zone), and which does not irritate the skin by its adhesive. Tests have shown that it is quite easy to manufacture products with delamination strengths substantially exceeding those of the prior art's mechanical linkage.

The proposed solution, therefore, offers many advantages:

- the manufacturer has many ways of adorning a product and to make it substantially more attractive, for example, the product need not be peripherally embossed thereby remaining perfectly flat and being more easily finished,
- the adhesive can be dyed to achieve an aesthetic edge effect with the adhesive being applied between the plies and thus the pigments being unlikely to touch the skin,
- an arbitrary embossing pattern can be selected without regard to the shape, pattern or inter-relation of embossments, such as spot to spot or nesting; mechanical linkage between the plies is not required.

In another feature of the invention, plies having different fiber and/or chemical compositions are peripherally bonded to each other.

In this particular embodiment, one ply containing an additive increasing the wet paper strength is associated with at least one ply without an additive or else comprising a softness-improving additive. In this manner, a stratified compound is achieved which combines properties that are unavailable in a single ply.

In another embodiment of the invention, plies made from different pulps are combined. For example, in the case of a three-ply handkerchief, the central ply can be made from a pulp of lower cost than, illustratively, CTMP or bisulfite cover plies.

Obviously chemical additives known to the expert can be incorporated at his discretion.

Other features and advantages are elucidated in the non-restrictive description below relating to the attached drawings.

Figure 1:
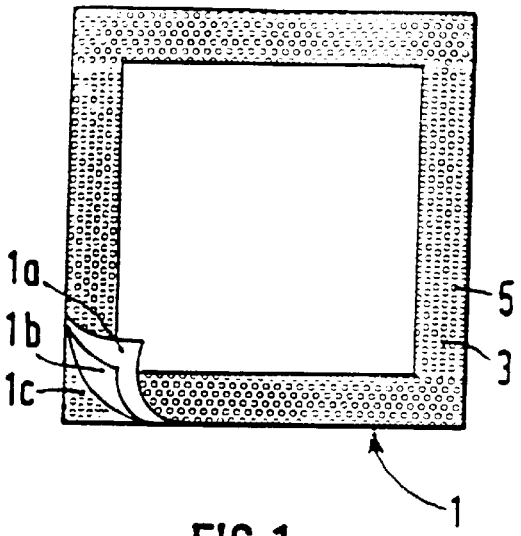
FIG. 1 is a product, for example a handkerchief, including a peripheral bond of the various plies with a delaminated corner showing the plies.

FIG. 1, schematically, is a top view of a handkerchief or a square napkin 1 composed of three tissue plies 1*a*, 1*b* and 1*c* adhesively interbonded at the periphery along a zone 3 of specified width. In the illustrated embodiment, bonding is at spots 5 so that the compound is free of stiffness. In the invention, the central zone is free of adhesive. Where desired, the central zone can be embossed for improved aesthetics.

The peripheral zone 3 covers less than 50% of the total surface of the handkerchief or napkin and, preferably, this zone is 30% to 40% of the total surface.

For example, a napkin of 40cm×40 cm is fitted with an edge bonding zone from edge inward by 4 cm. In this manner, this zone covers 36% of the total napkin surface.

In an especially preferred embodiment of the invention, the bonding is implemented starting at the ply edges in order to avert any gap between the plies or unaesthetic creasing at the periphery.

Figure 3:
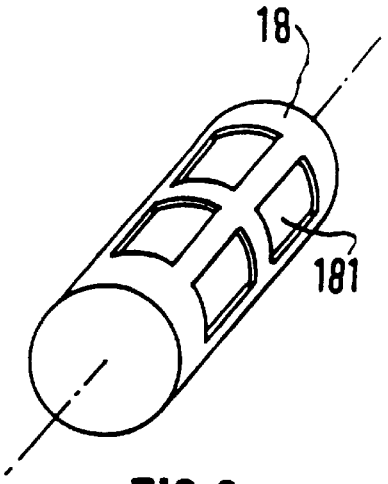
FIG. 3 is a detail of the apparatus of FIG. 2.
Figure 2:
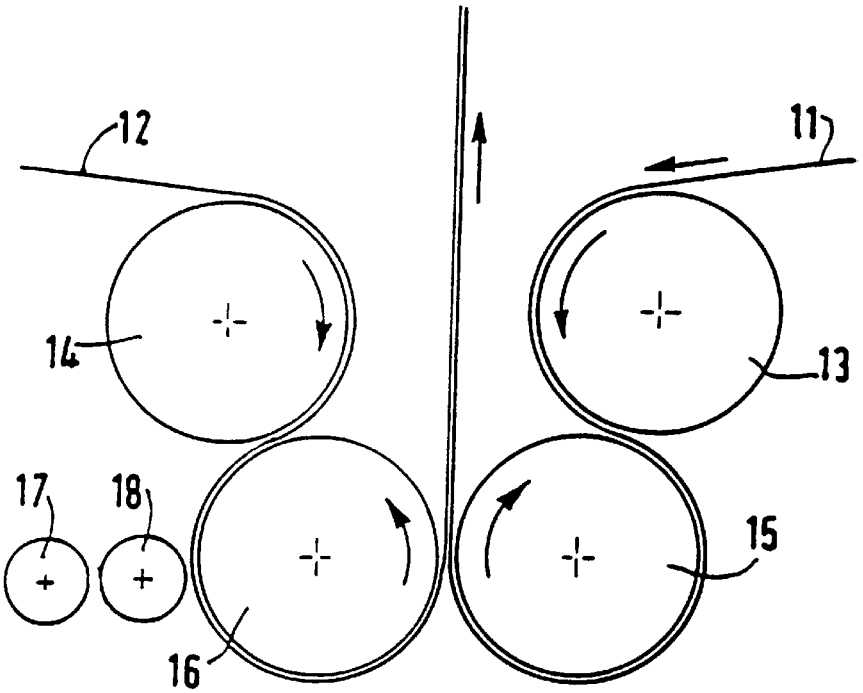
FIG. 2 shows apparatus for the manufacture of products of the invention.

Any known apparatus, illustratively that shown in FIG. 2, can be used to manufacture the above product. The tissue plies 11 and 12, one of which can be double, are fed from their respective (not shown) rolls and are made to pass around rubber cylinders 13 and 14 and, then, between them and steel embossing cylinders 15 and 16 which are fitted with appropriate topologies along a peripheral zone according to the desired product's format. Illustratively, such protrusions can be distributed in the manner shown in FIG. 1. One of the plies, namely 12, is pasted by means of a rubber adhesive-depositing cylinder 18 shown in FIG. 3. In one embodiment, this cylinder includes a recessed part 181 matching the peripheral adhesive-coated zone of the plies, whereby the adhesive from the depositing cylinder is spread in this pattern. In this embodiment, one or both plies can be embossed over their entire surface. The adhesive is deposited only on the periphery which matches the part 181 of the pasting cylinder. In another embodiment, either of or both cylinders 15 and 16 are fitted with suitable topologies along a peripheral zone of the desired product format. Thereupon, a smooth adhesive coating cylinder can be used.

Following adhesive coating, the plies 11 and 12 are joined in the compression gap between the embossing cylinders 15 and 16 rotating at the same speed but in opposite directions. The poly-ply sheet issuing from the apparatus is moved toward a processing station where it is cut and folded according to the particular application, such as handkerchiefs, napkins and the like.

In a method variation, plies 11 and 12 can be fed from one, double-ply spool and be calendared jointly to smooth the outer surface and impart greater softness. Only thereafter are the two plies separated for separate and individual embossing.

In another method variation not shown, one ply, either single or double, is embossed between a rubber cylinder and a suitably engraved steel cylinder, i.e., a cylinder with projections along the periphery of the desired product format. The adhesive is deposited at the top of the projections. Lastly, a second and a third ply are placed on the first ply by means of a third rubber cylinder of the wed type. This third cylinder simultaneously assures embossing of the second and third plies at its junction to the first ply. The third cylinder also can be a steel or paper cylinder.

Tests were run on the delaminations of the products of the invention and those of the prior art.

A handkerchief was made by bonding with an adhesive in solution in water and PVA, three plies each being 21.5 cm×21.5 cm and having along their peripheries a strip 2 cm wide.

Test pieces 15 mm wide were cut from the bonded zones of the handkerchiefs and delamination tests were run at 180° C. Such a test consists in measuring the mean delamination strength of a test specimen at a specified constant speed of 100 mm/min. For that purpose, the ends of the two plies to be tested for delamination strength are clamped between two pairs of jaws which then are moved apart at constant speed and the opposing force is measured. Its magnitude is normalized with respect to width.

| 180° C. Delamination mean-strength (g/cm)/ maximum tested strength | Prior art control linked by single embossing | Adhesively bonded sample |
|---|---|---|
| L | 0.55/1 | 2.4/6.4 |
| T | 0.65/1 | 6.2/20 |

The adhesive bonding is shown to substantially increase delamination strength both in the longitudinal direction (direction of advance) L and in the transverse direction T.

Measurements taken on a large number of extant commercial products have shown that regardless of the embossing pattern, whether by tips or sets of ridging bars, the mechanical connection will not reliably assure delamination strength of 1 g/cm in either the L or T direction.

EXAMPLES

Product I

A handkerchief is made from three tissue plies consisting of 60% resin fibers and 40% deciduous-wood fibers, each with a density of 18 g/m2 and comprising an additive at the rate of 1.5 kg per ton to loosen the fibers in order to make the product softer (sold by ENKA NOBEL as BEROCELL 595). The prior art of peripheral embossing is unable to produce such a product because of the presence of the additive.

Product II

A handkerchief is made wherein the central ply is made from a mixture of resin pulps (75%), deciduous-wood pulp (10%) and of thermo-mechanical chemical pulp (21 g/m$^2$density) including a wet-state improving properties additive (sold by HERCULES as KYMENE 557 H); and the two cover plies are made from a mixture of resin pulps (65%) and deciduous-wood pulp (35%) with a density of 14.5 g/m$^2$ incorporating an additive (BEROCELL 595) for softness. Bonding was by peripheral adhesion.

Product III

A control handkerchief was made with three plies having a density of 18 g/m$^2$ and without additive, the linking being by embossing.

Dry and wet strength tests and burst resistance were run on 15 mm wide test specimens cut from the ply linkage/bonding zones and are set forth in the table below as length of rupture (cm) for each of the three products:

| | I | II | III |
|---|---|---|---|
| Measured density (g/m$^2$) | 52.8 | 49.3 | 51.8 |
| Thickness (mm) | 0.20 | 0.21 | 0.18 |
| Dry strength | | | |
| L | 505 | 630 | 580 |
| T | 180 | 280 | 220 |
| Elongation | 10.5% | 11% | 12.5% |
| Wet strength | | | |
| L | 130 | 165 | 175 |
| T | 52 | 95 | 65 |

-continued

| | I | II | III |
|---|---|---|---|
| Burst strength | | | |
| dry | 330 | 440 | 450 |
| wet | 100 | 170 | 115 |

Compared with control sample III, the invention allows for making products with a wide range of properties depending on the application being considered.

We claim:

1. A product comprising at least two superposed calendered creped tissue paper plies of a desired shape which are connected to one another along a peripheral zone of said plies by adhesive bonding in such manner that a minimum delamination strength of 1 g/cm is evinced; said peripheral zone being less than 50% of the total surface of said product and thus a central area more than 50% of the total surface of said product in said at least two superposed plies is present which is free of adhesive, and a sum of bonding areas between said plies is less than the area of said peripheral zone.

2. Product according to claim 1 wherein said adhesive bonding is present in said plies' entire periphery.

3. Product according to either claim 1 or claim 2 wherein said adhesive bonding is carried out in such manner that adhesive is deposited in spots discontinuously distributed over said peripheral zone.

4. Product according to either claim 1 or claim 2 further comprising embossing in said peripheral zone.

5. Product according to claim 3 further comprising embossing in said peripheral zone.

6. Product according to either claim 1 or claim 2 wherein at least two plies of said at least two plies have a different chemical and/or fibrous composition.

7. Product according to claim 6 wherein one of said at least two plies of said at least two plies contains an additive for improving wet strength.

8. Product according to claim 6 wherein one of said at least two plies of said at least two plies contains a softness-improving additive.

9. Product according to claim 7 wherein one of said at least two plies of said at least two plies contains a softness-improving additive.

10. Product according to claim 6 wherein said at least two plies of said at least two plies are made from different pulps.

11. Product according to claim 7 wherein said at least two plies of said at least two plies are made from different pulps.

12. Product according to claim 8 wherein said at least two plies of said at least two plies are made from different pulps.

13. Product according to claim 9 wherein said at least two plies of said at least two plies are made from different pulps.

* * * * *